United States Patent [19]

Solow et al.

[11] Patent Number: 4,725,054

[45] Date of Patent: Feb. 16, 1988

[54] LOW INERTIA COUNTERBALANCE MECHANISM

[75] Inventors: Howard J. Solow, Nesconset; George F. Rehrl, Central Islip, both of N.Y.

[73] Assignee: Lumex, Inc., Bay Shore, N.Y.

[21] Appl. No.: 802,846

[22] Filed: Nov. 27, 1985

[51] Int. Cl.[4] ..... A63B 21/00

[52] U.S. Cl. ..... 272/130; 272/134; 272/116; 272/DIG. 4

[58] Field of Search ..... 272/117, 118, DIG. 4, 272/93, 128, 130, 132, 134, DIG. 1; 128/25 R

[56] References Cited

U.S. PATENT DOCUMENTS

| | | | |
|---|---|---|---|
| 2,223,309 | 11/1940 | Swanson | 272/147 |
| 2,328,082 | 8/1943 | Lawrence | 296/57 R |
| 2,855,199 | 10/1958 | Noland et al. | 272/117 |
| 3,429,072 | 2/1969 | Sammons | 49/203 |
| 3,826,532 | 7/1974 | Caldemeyer | 297/270 |
| 3,858,873 | 1/1975 | Jones | 272/117 |
| 4,183,520 | 1/1980 | Chase | 272/130 |
| 4,348,045 | 9/1982 | Hori et al. | 296/14 |
| 4,437,701 | 3/1984 | Mizelle | 297/85 |
| 4,462,252 | 7/1984 | Smidt et al. | 272/134 X |
| 4,477,071 | 10/1984 | Brown et al. | 272/134 X |
| 4,577,623 | 3/1986 | Pecheux | 128/25 R |
| 4,600,189 | 7/1986 | Olschansky | 272/134 X |
| 4,616,825 | 10/1986 | Anderson | 272/117 X |

OTHER PUBLICATIONS

"Quantitative Assessment of Back Strength Using Isokinetic Testing", *Spine*, vol. 9, No. 3, 1984 (287–290.

*Primary Examiner*—Richard J. Apley
*Assistant Examiner*—Howard Flaxman
*Attorney, Agent, or Firm*—Davis Hoxie Faithfull & Hapgood

[57] ABSTRACT

A low inertia counterbalance mechanism for eliminating the effects of gravity on an upper body mass of a person secured in an input assembly of a trunk extension/flexion test, rehabilitation and exercise machine is disclosed. The mechanism disclosed does not add any appreciable inertia to the input assembly. A cam rotating on the same axis of rotation and mechanically connected to the input assembly comes in contact with a cable when the input assembly rotates downwardly. The cable at its bottom end is attached to a lever arm. The lever arm rotates upwardly when the cam comes in contact with the cable, and a constant force gas spring pivotally attached at its bottom end to an intermediate point on the lever arm is compressed when the lever arm pivots upwardly. This negates the increasing effects of gravity felt by the upper body mass of the person secured in the input assembly as the input assembly rotates downwardly. The top end of the spring is pivotally attached to a frame of the machine. The attachment point of the bottom end of the gas spring to the lever arm can be changed so as to passively carry the upper body mass of the person upwardly without the person exerting any upward rotational force. The point in the range of motion where the cam comes in contact with the cable is also adjustable.

9 Claims, 7 Drawing Figures

LOW INERTIA COUNTERBALANCE MECHANISM

FIELD OF THE INVENTION

This invention relates to a low inertia counterbalance mechanism for eliminating the effects of gravity on a mass of a rotating member, particularly for limiting the effects of gravity on the upper body mass of a person secured to a rotating input assembly on a trunk extension/flexion test, rehabilitation and exercise machine.

BACKGROUND OF THE INVENTION

For test, rehabilitation and exercise machines where rotary motion of a person's musculature is involved, and gravity exerts a force on the body mass engaged in the rotary motion, it is important to counterbalance the effects of gravity so that the person can engage in the rotary motion without interference from the gravitational force. This is particularly important for trunk extension movement on a trunk extension/flexion test, rehabilitation and exercise machine where the person may not be able to overcome gravity and engage in trunk extension movement without some sort of counterbalancing of the force of gravity. Further, some individuals may have such severe trunk extension strength limitations that they cannot engage in trunk extension movement even if gravity is totally counterbalanced. Rather, such individuals require that the trunk extension/flexion machine positively move them through the trunk extension movement without their exerting any upward rotational force whatsoever.

Also, it is desirable to be able to quickly and easily counterbalance for different upper body masses on the trunk extension/flexion machine so that the proper counterbalancing is achieved for a variety of individuals.

Any counterbalance mechanism on a test, rehabilitation or exercise machine, to be truly effective, should not add any appreciable amount of inertia to that part of the machine which rotates. If an appreciable amount of inertia is added, the force which the person must exert to accelerate or decelerate that part of the machine which rotates is increased. This is undesirable, especially for persons who have limited rotational strength and may not be able to exert a sufficient rotational force to overcome the added inertia. Also, any added inertia will tend to force the person to engage in a greater range of trunk flexion motion than the person is capable, causing pain and possibly injury to the person.

Presently, counterbalancing on test, rehabilitation and exercise machines is accomplished by adding counterbalancing weights. These prior counterbalancing mechanisms add unwanted inertia to the system. Further, counterbalance mechanisms presently known to applicants on test, rehabilitation and exercise machines do not provide the ability to quickly and easily counterbalance a wide variety of body masses or provide positive force to move a person through a trunk extension or upward rotational movement.

SUMMARY OF THE INVENTION

The present invention is for a low inertia counterbalance mechanism for eliminating the effects of gravity on an upper body mass of a person secured in an input assembly of a test, rehabilitation and exercise machine, wherein the input assembly engages in vertical rotary motion.

The mechanism of the present invention has a cam mechanically connected to the input assembly wherein the cam rotates on the same axis of rotation as the input assembly. When the input assembly rotates downwardly, a groove on the cam comes into contact with a cable. At a top end the cable is attached to the axis of rotation of the input assembly and at a bottom end the cable is attached to a clevis on a second end of a lever arm. A turnbuckle located intermediate the top end and the bottom end of the cable is used to take up slack in the cable.

A first end of the lever arm is pivotally attached to a frame of the machine. Intermediate the first end and the second end of the lever arm is a glide plate movably attached to the lever arm. Pivotally attached to a clevis on the glide plate is a bottom end of a gas spring. The top end of the gas spring is pivotally attached to the frame of the machine.

As the input assembly rotates downwardly, the groove of the cam comes in contact with the cable, causing the lever arm to pivot upwardly. When the lever arm pivots upwardly the gas spring is compresssed, thus negating the increasing effect of gravity on the upper body mass of the person secured in the input assembly. As the input assembly rotates upwardly the gas spring, through the lever arm, applies a force on the cable, and the cable, through the cam, applies a rotational force to the input assembly tending to help the upper body mass of the person secured in the input assembly to overcome gravity.

The point in the rotary range of motion of the input assembly where the groove of the cam comes in contact with the cable is adjustable by engaging a pull pin on the cam in one of a number of counterbalance holes in a position plate which is mounted to an input arm on the input assembly and which rotates in the same axis of rotation as the input assembly.

By changing the position of the glide plate on the lever arm, the mechanism of the present invention can be adjusted to passively carry the upper body of a person secured in the input assembly through an upward rotation.

The low inertia counterbalance mechanism of the present invention may be used to eliminate the effects of gravity on a mass of any rotating member, not just a rotating input assembly on a test, rehabilitation and exercise machine.

DETAILED DESCRIPTION OF THE INVENTION

Figure 1:
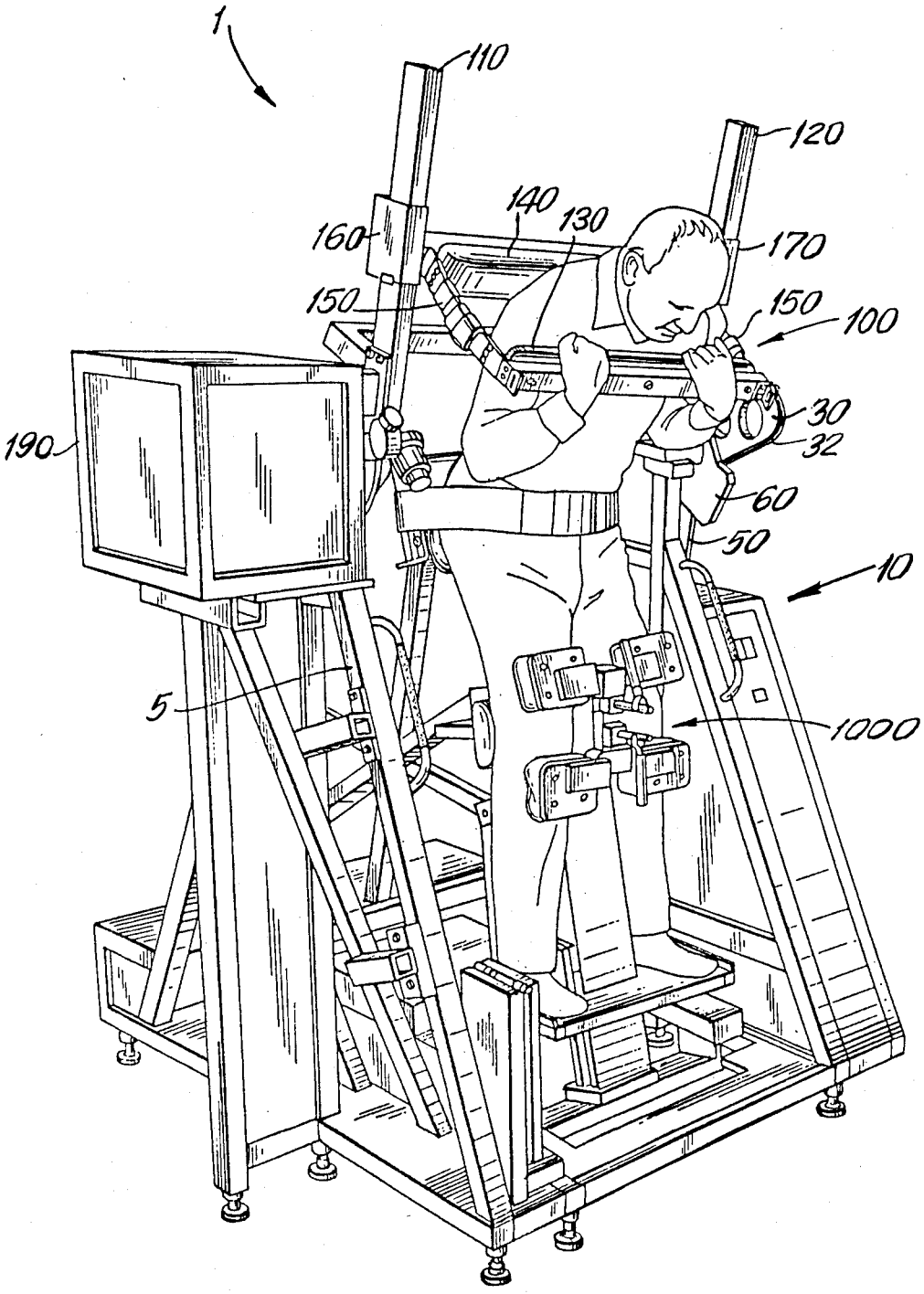
FIG. 1 is a perspective view of a trunk extension/-flexion test, rehabilitation and exercise machine which contains a low inertia counterbalance mechanism of the present invention wherein a person who is secured in an input assembly of the machine is in a bent over or trunk flexion position.
Figure 2:
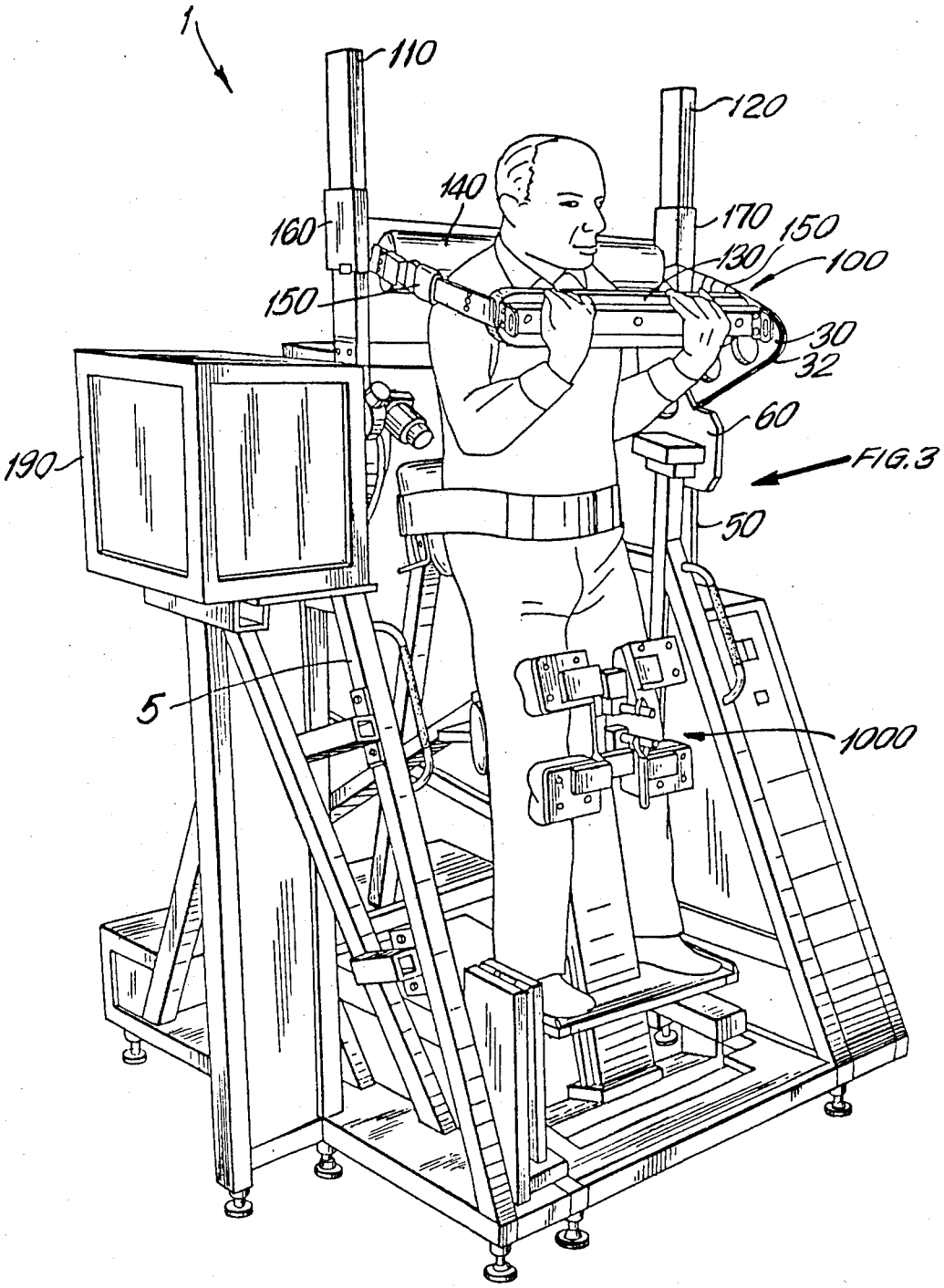
FIG. 2 is another perspective view of the trunk extension/flexion machine of FIG. 1 wherein the person is in a straight up or trunk extension position.

A trunk extension/flexion test, rehabilitation and exercise machine 1 which contains a low inertia counterbalance mechanism 10 of the present invention is shown in FIGS. 1 and 2. The machine 1 is designed for the testing, rehabilitation and exercise of the trunk musculature used in trunk extension and trunk flexion movement. FIG. 1 shows a person secured to the machine 1 wherein the person is in the trunk flexion or bent at the waist position. FIG. 2 shows the person secured to the machine 1 wherein the person is in the trunk extension or straight up position.

An input assembly 100 of the machine 1, which includes two input arms 110 and 120, a chest pad 130 and a scapula pad 140, as shown in FIGS. 1 and 2, rotates downwardly when the person engages in trunk flexion movement and rotates upwardly when the person engages in trunk extension movement. A trunk flexion movement is movement from the position shown in FIG. 2 to the position shown in FIG. 1. A trunk extension movement is movement from the position shown in FIG. 1 to the position shown in FIG. 2. The input arm 120 rotates over a stationary shaft 105 (shown in FIGS. 3, 4, and 5). As the input assembly 100 rotates a cam 30 will also rotate on the same axis of rotation as the input assembly 100.

Figure 3:
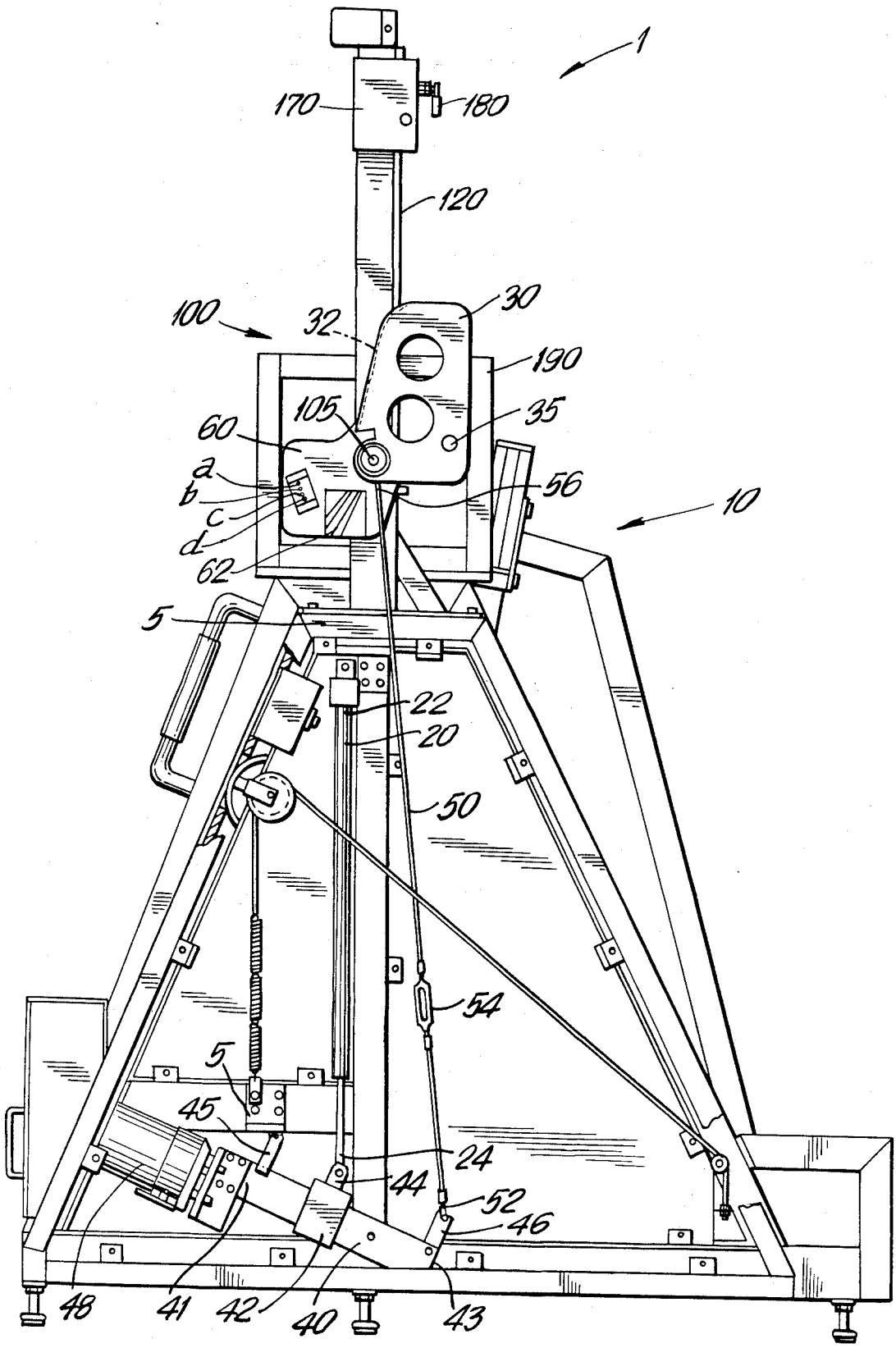
FIG. 3 is a partial side elevational view, partly in section, of the machine of FIG. 2 along the direction of the arrow of FIG. 2 wherein a cam of the low inertia counterbalance mechanism of the present invention is rotated to show a position plate of the low inertia counterbalance mechanism of the present invention.
Figure 4:
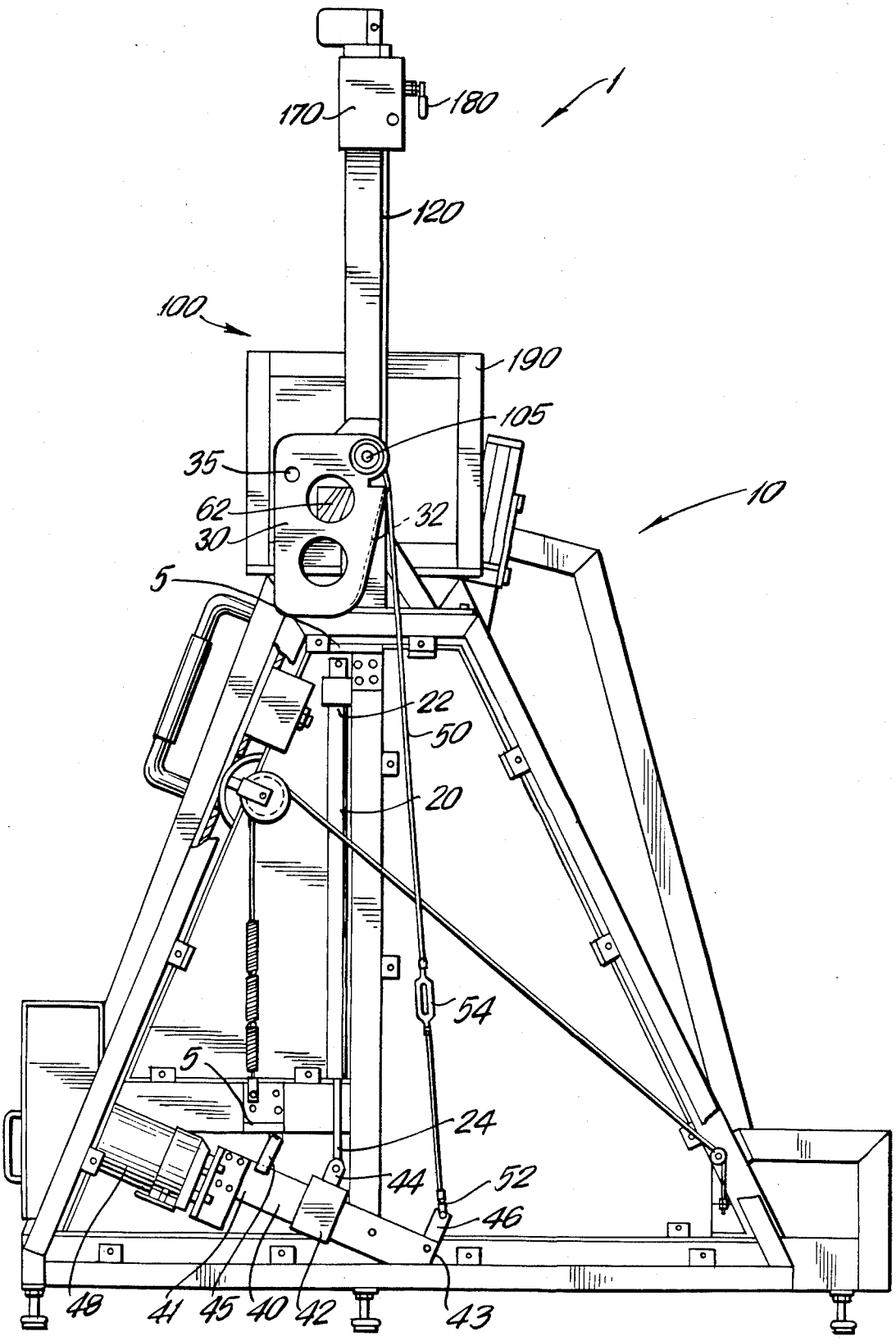
FIG. 4 is another partial side elevational view, partly in section, of the machine of FIG. 2 wherein the cam is engaged in a counterbalance hole in the position plate such that counterbalance will occur when an input arm of the input assembly of the machine is rotated downwardly.
Figure 5:
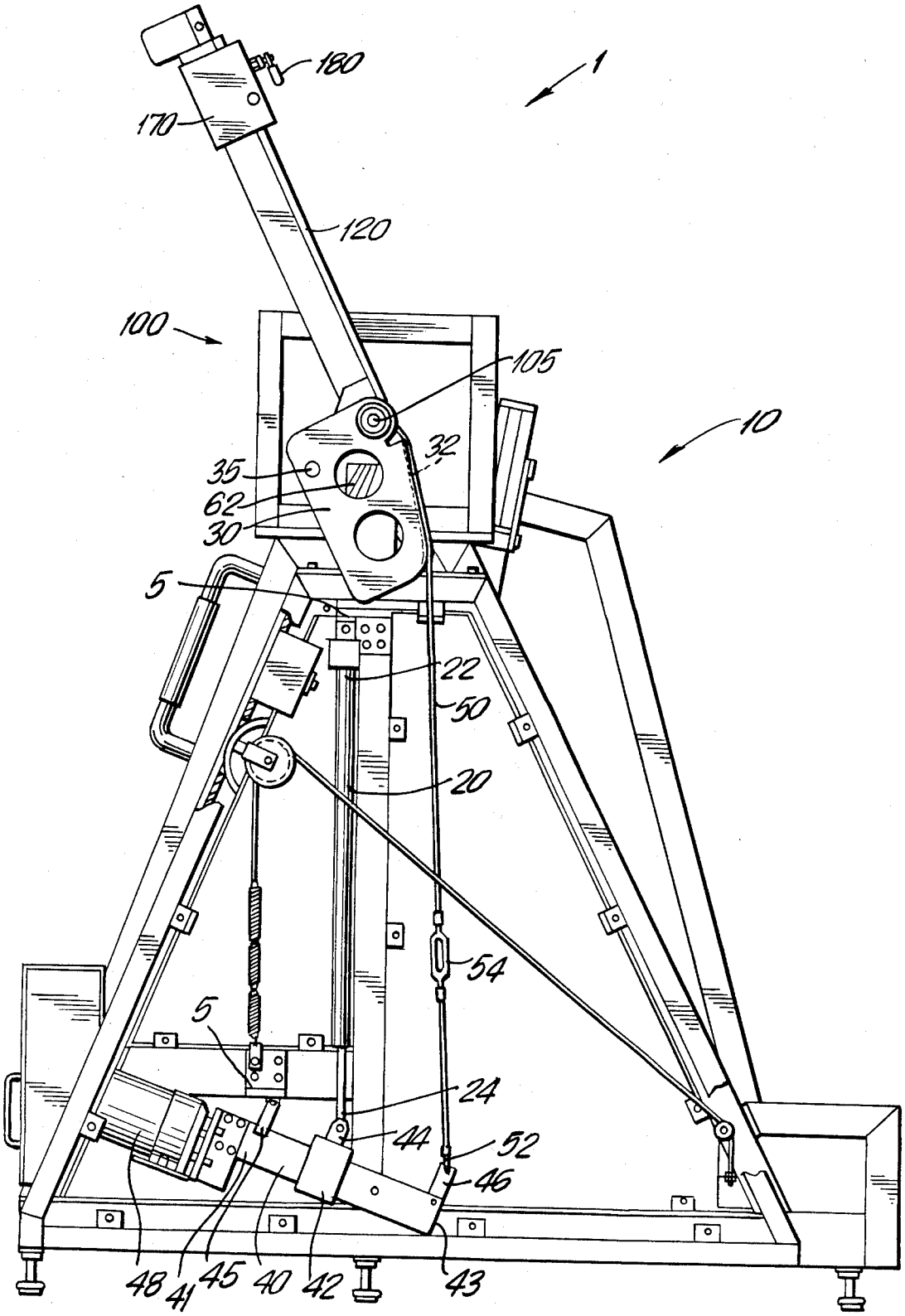
FIG. 5 is a view of the machine of FIG. 4 wherein the input arm of the input assembly of the machine is rotated downwardly and counterbalance occurs.

As seen in FIGS. 1 and 2, the chest pad 130 of the input assembly 100 bears against the chest of the person and the scapula pad 140 bears against the scapula. The chest pad 130 is attached to the scapula pad 140 by belts 150. The scapula pad 140 is attached to slide blocks 160 and 170 which slide over input arms 110 and 120 respectively. Slide blocks 160 and 170 are locked at any desired vertical position on input arms 110 and 120 using a suitable locking means such as toggle clamps 180. One toggle clamp 180 is shown in FIGS. 3, 4 and 5.

The input assembly 100 is rotatably attached to a frame 5 of the machine 1 such that the input assembly 100 will rotate upwardly in relation to the frame 5 when the person engages in trunk extension movement and will rotate downwardly in relation to the frame 5 when the person engages in trunk flexion movement.

An isokinetic dynamometer (not shown), which is mechanically connected to the input assembly 100, measures the force which the person is able to exert in trunk flexion movement and in trunk extension movement. The dynamometer operates on the well-known theory of isokinetics whereby the rotational speed of the input assembly 100 cannot exceed a pre-determined limit. The pre-determined rotational speed of the input assembly 100 is set by making a selection from dynamometer controls (not shown) on the dynamometer.

The general theory of isokinetics is described in U.S. Pat. No. 3,465,592 issued to J. J. Perrine on Sept. 9, 1969. The description of isokinetics contained in that patent is incorporated herein by reference.

Until such time as the person exerts a force on the chest pad 150 or the scapula pad 140 sufficient to make the input assembly 100 rotate at the pre-determined speed, the person will not feel any resistive force. However, any attempt by the person to accelerate the input assembly 100 beyond the pre-determined speed results in the dynamometer providing an accommodating, resistive force equal to the force exerted by the person. Therefore, the person cannot make the input assembly 100 rotate any faster than the pre-determined set speed, and any increased force exerted by the person is met by an equal accommodating, resistive force from the dynamometer.

The isokinetic dynamometer in the present embodiment is similar to the dynamometer which is available as part of the Cybex® II+ test, rehabilitation and exercise machine, which is manufactured and sold by the Cybex Division of Lumex Inc., 2100 Smithtown Ave., Ronkonkoma, N.Y.

Since the dynamometer provides an accommodating, resistive force equal to the force exerted by the person, measurement of the force provided by the dynamometer is also a measurement of the strength of the person's trunk musculature through the trunk extension and trunk flexion movements. A computer (not shown) can be used to record this measurement and process a group of measurements for further analysis of the person's progress during the test, rehabilitation or exercise procedure.

In the present embodiment, the isokinetic dynamometer is located in a dynamometer enclosure 190. The dynamometer enclosure 190 is rigidly attached to the frame 5 of the machine 1.

During the test, rehabilitation or exercise procedure using the trunk extension/flexion machine 1, the legs of the person are stabilized against extraneous movement by a leg stabilization apparatus 1000. The leg stabilization apparatus 1000 is the subject of a copending application in the name of George F. Rehrl, filed concurrently herewith. The description contained in that application of the leg stabilization apparatus 1000 is incorporated herein by reference.

As the person engages in trunk flexion movement, i.e., moves from the position shown in FIG. 2 to the position shown in FIG. 1, the force of gravity will tend to accelerate the rotary motion because of the mass of the upper body of the person. The person will feel the gravitational force on the upper body mass as the input assembly 100 rotates downwardly. With persons who have trunk musculature strength and range of motion limitations, this gravitational force can interfere with the test, rehabilitation or exercise procedure on the machine 1.

The low inertia counterbalance mechanism 10 of the present invention negates the effects of gravity as the person engages in trunk flexion movement without adding inertia to the input assembly 100, as described below.

Further, persons with trunk musculature strength limitations may have difficulty in engaging in trunk extension movement because they do not have the strength to overcome gravity in attempting to move from the position shown in FIG. 1 to the position shown in FIG. 2.

The low inertia counterbalance mechanism 10 of the present invention can be adjusted to exactly counterbalance the effect of gravity during trunk flexion movement. Further, the mechanism 10 can be adjusted to not only negate the effect of gravity during trunk flexion movement but also to rotate the upper body of the person upwardly during trunk extension movement without the person exerting any upward rotational force against the scapula pad 140. Thus, the upper body mass of the person can be passively carried through the upward rotational movement of trunk extension.

The low inertia counterbalance mechanism 10 of the present invention is shown in detail in FIGS. 3, 4, 5, 6 and 7.

A top end 22 of a constant force gas spring 20 is pivotally attached to the frame 5 of the machine 1. A bottom end 24 of the gas spring 20 is pivotally attached to a spring clevis 44 on a glide plate 42. The glide plate 42 is movably attached to a lever arm 40, as described below.

The gas spring 20 in the present embodiment is of conventional construction and is a constant force spring, model F3262 manufactured and sold by the Gas Spring Company, Colmar, Pa. Further, in the present embodiment, a second gas spring, positioned directly behind gas spring 20 in FIGS. 3, 4, 5 and 7, is used. The top and bottom ends of the second gas spring are attached to the frame 5 and the spring clevis 44 in exactly the same manner as the gas spring 20.

All descriptions given below of the structure and operation of the gas spring 20 also apply to the second gas spring.

A cable 50 has a bottom end 52 which is attached to a cable clevis 46 of the lever arm 40. The bottom end 52 of the cable 50 is a crimped loop. A top end 56 of the cable 50, which is also a crimped loop, fits over the shaft 105 over which the input arm 120 rotates.

Slack in the cable 50 is taken up by a turnbuckle 54 located intermediate the top end 56 and the bottom end 52 of the cable 50 as seen in FIGS. 3, 4, 5 and 7. Adjusting the turnbuckle 54 insures that the cable 50 is always taut.

A first end 41 of the lever arm 40 has a pivot clevis 45 which is pivotally attached to the frame 5 of the machine 1. The first end 41 of the lever arm 40 also has a second pivot clevis 45', located on the other side of the lever arm 40. The second pivot clevis 45' is also pivotally attached to the frame 5 of the machine 1. The pivotal attachment of the pivot clevises 45 and 45' to the frame 5 result in the first end 41 of the lever arm 40 being able to pivot relative to the frame 5. A second end 43 of the lever arm 40 has a cable clevis 46. The bottom end 52 of the cable 50 is attached to the cable clevis 46 of the lever arm 40.

Figure 6:
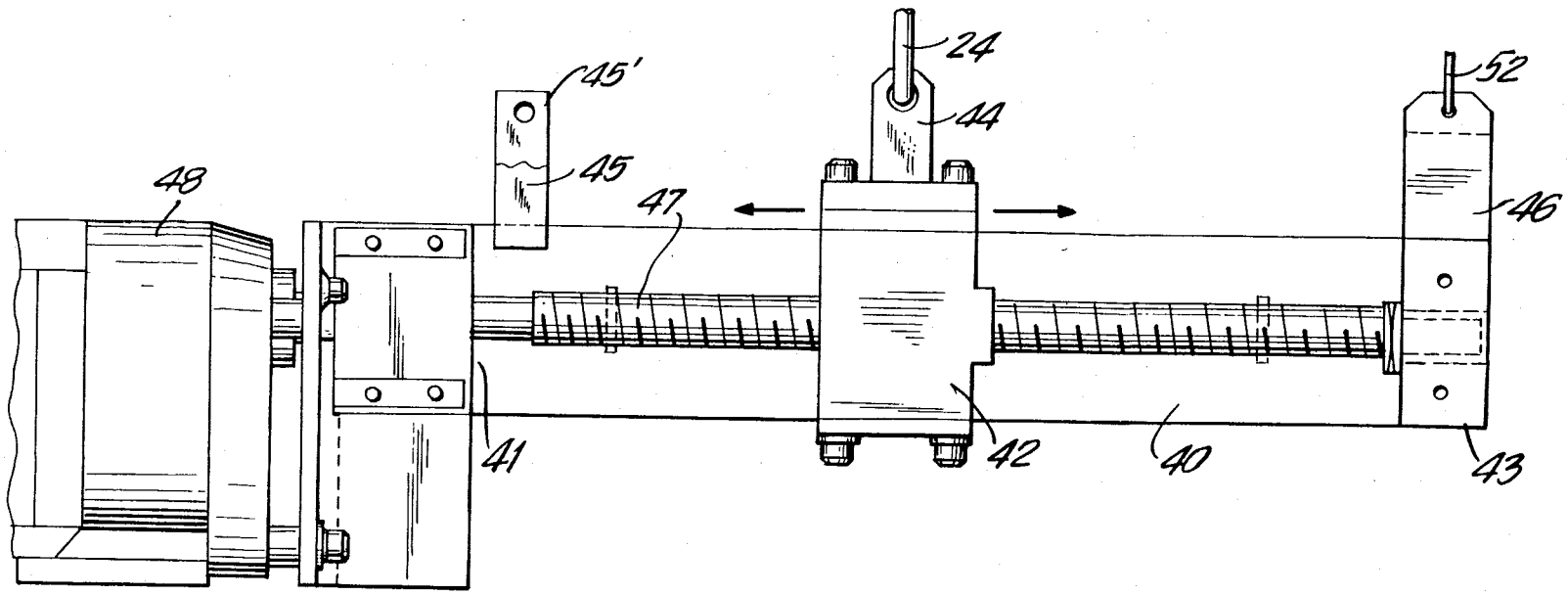
FIG. 6 is an isolated side elevational view, partly in section, of a lever arm of the low inertia counterbalance mechanism of the present invention.

Referring to FIG. 6, movably mounted on the lever arm 40 is a slide means, in this embodiment the glide plate 42. The position of the glide plate 42 on the lever arm 40 may be changed by the operator using a drive motor 48. The drive motor 48 drives a ball screw 47 in the lever arm 40 which in turn moves the glide plate 42. The glide plate 42 may move in the direction of the arrows in FIG. 6.

The cam 30 is engaged through a pull pin 35 to a position plate 60 and rotates on the same axis of rotation as the input assembly 100. The cam 30 causes counterbalancing of the upper body mass of the person when the pull pin 35 of the cam 30 is engaged in one of four counterbalance holes a, b, c, or d on the position plate 60. The position plate 60, best seen in FIG. 3, is mounted to the input arm 120 and rotates in the same axis of rotation over the shaft 105 as the input assembly 100, at every point in the range of motion. The nature of the engagement of the pull pin 35 in the position plate 60 causes the cam 30 to be mechanically connected to the input arm 120 and therefore also to the input assembly 100.

FIG. 4 shows the pull pin 35 of the cam 30 engaged in couterbalance hole b on position plate 60. A position label 62 on the position plate 60 is used for easy reference as to which counterbalance hole (a, b, c, or d) on the position plate 60 the pull pin 35 of the cam 30 is engaged.

The counterbalance mechanism 10 of the present invention operates as follows.

With the cam 30 positioned as shown in FIG. 4, rotating the input assembly 100 to the position shown in FIG. 5 will cause a groove 32 in the cam 30 to contact the cable 50. Further rotation of the input assembly 100 will cause the cam 30 to displace the cable 50, which causes the lever arm 40 to pivot upwardly. The upward rotation of the lever arm 40 will cause the gas spring 20 to compress. As the input assembly 100 rotates downwardly and gravity has increasing effect, the shape of the cam 30 provides an increasing counterbalance to the increasing effect of gravity. The shape of the cam 30 is designed to accommodate the widest variety of upper body size and mass variations as possible.

As the input assembly pivots upwardly from the position shown in FIG. 5 to the position shown in FIG. 4, the gas spring 20 applies a force to the cable 50 through the lever arm 40, and the cable 50, through the cam 30, applies a rotational force to the input assembly 100, tending to help the input assembly 100 overcome gravity.

The point in the rotational range of motion of the input assembly 100 where counterbalance will come into effect is variable, depending on where the pull pin 35 of the cam 30 is engaged on the position plate 60. Engaging the pull pin 35 of the cam 30 in counterbalance holes c or d on position plate 60 will result in counterbalance occurring earlier in the flexion range of motion compared to counterbalance hole b on position plate 60 because the groove 32 of the cam 30 will come into contact with the cable 50 sooner for counterbalance holes c and d than for counterbalance hole b. Similarly, engaging the pull pin 35 of the cam 30 in counterbalance hole a on position plate 60 will result in counterbalance occurring later in the flexion range of motion compared to counterbalance hole b because the groove 32 of the cam 30 will come into contact with the cable 50 later for the counterbalance hole a than for counterbalance hole b.

A fifth position of cam 30 results in no counterbalance because the groove 32 of the cam 30 never comes into contact with the cable 50 as the input assembly 100 rotates downwardly. FIGS. 1 and 2 show a position of the cam 30 wherein no counterbalancing results.

The pull pin 35 is released from the counterbalance holes a, b, c or d by exerting a pulling force on the pull pin 35.

Moving the glide plate 42 on the lever arm 40, using the drive motor 48 to drive the ball screw 47, increases or decreases the tension in the cable, which increases or decreases the counterbalance effect, depending on which direction the glide plate 42 is moved on the lever arm 40.

Figure 7:
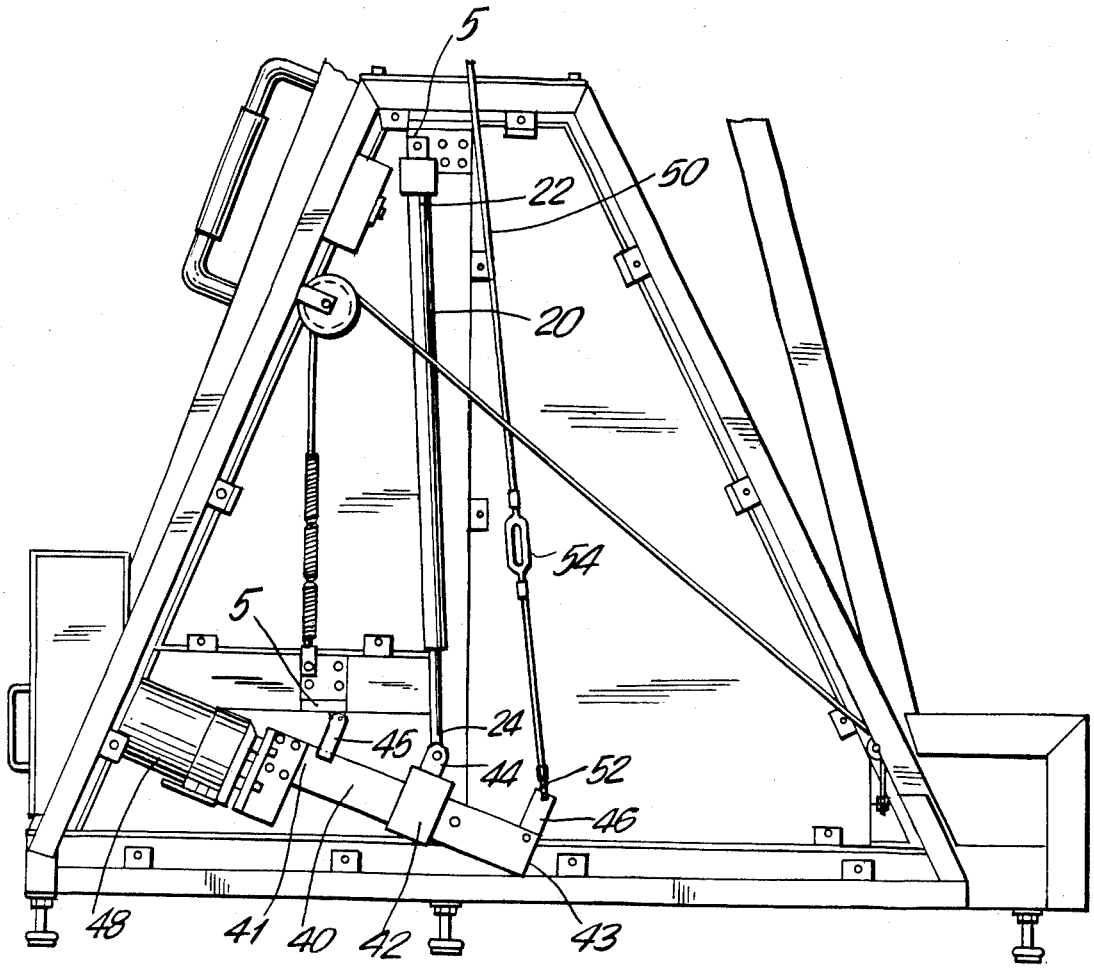
FIG. 7 is a partial view of the machine of FIG. 5 showing a change in position from the position shown in FIG. 5 of a glide plate on the lever arm of the low inertia counterbalance mechanism of the present invention.

FIG. 7 shows the glide plate 42 moved to the right in relation to the position of the glide plate 42 in FIG. 5. Moving the glide plate 42 to the right on the lever arm 40 increases the distance between the first end 41 of the lever arm 40 and the attachment of the bottom end 24 of the spring 20 to the spring clevis 44. As is well understood from the physics of levers, moving the glide plate 42 to the right as shown in FIG. 7 increases the downward pivotal force which the spring 20 will exert against the second end 43 of the lever arm 40, thus providing a greater counterbalancing effect. Similarly, moving the glide plate 42 to the left decreases the distance between the first end 41 of the lever arm 40 and the attachment of the bottom end 24 of the spring 20 to the spring clevis 44, decreasing the downward pivotal force which the spring 20 will exert against the second end 43 of the lever arm 40, and thus providing a lesser counterbalancing effect.

Because the top end 22 of the gas spring 20 is pivotally attached to the frame 5 of the machine 1, and the bottom end 24 of the spring 20 is pivotally attached to the spring clevis 44 of the glide plate 42 on the lever arm 40, the gas spring 20 is subject to only axial loading as the glide plate 42 is moved on the lever arm 40.

For a person with severe trunk extension strength limitations, such that the person cannot engage in trunk extension movement against the force of gravity, the counterbalance mechanism 10 of the present invention can be used to overcome gravity and passively carry the person from the position shown in FIG. 1 to the position shown in FIG. 2. This is accomplished by first positioning the glide plate 42 closest to the first end 41 of the lever arm 40, and engaging the pull pin 35 of the cam 30 in one of the counterbalance holes a, b, c or d on position plate 60 so that the cable 50 rides in the groove 32 of the cam 30 throughout the entire range of motion from the position shown in FIG. 1 to the position shown in FIG. 2. Then, the position of the glide plate 42 is changed on the lever arm 40 by moving it to the right on the lever arm 40, to cause sufficient downward pivoting force on the second end 43 of the lever arm 40 thus increasing the counterbalance effect and overcoming gravity. In this arrangement, the person will be passively carried from the position shown in FIG. 1 to the position shown in FIG. 2 without the person having to exert any rotational force against the scapula pad 140.

Since weights are not used in the counterbalance mechanism 10 of the present invention, negligible inertia is added to the input assembly 100, and the person only needs to exert a minimal rotational force to accelerate or decelerate the input assembly 100.

Although the low inertia counterbalance mechanism has been described in terms of eliminating the effects of gravity on the upper body mass of a person secured to a rotating input assembly on a trunk extension/flexion test, rehabilitation and exercise machine, the present invention can be used for eliminating the effects of gravity on a mass of any rotating member.

It is further understood that applicant's invention is as set forth in the following claims.

We claim:

1. A low inertia counterbalance mechanism for negating the effects of gravity on a mass of a rotating member mounted on a fixed frame wherein the rotating member engages in vertical rotary motion comprising:

a cam mechanically connected to a rotating member and having the same axis of rotation as the rotating member wherein the cam rotates when the rotating member rotates;

a lever arm with a first end pivotally attached to the frame;

a cable with a top end attached to the axis of rotation of the rotating member and a bottom end attached to a second end of the lever arm wherein a groove of the cam comes in contact with the cable as the rotating member rotates downwardly in the direction of the force of gravity, causing the lever arm to pivot upwardly; and a constant force spring with a top end attached to the frame and a bottom end attached to the lever arm at a point intermediate the first end and the second end of the lever arm, wherein the top end of the constant force spring is always at a higher elevation than the bottom end of the constant force spring and wherein the constant force spring is compressed when the lever arm is pivoted upwardly opposite to the direction of the force of gravity negating the effect of gravity on the mass of the rotating member; and means for changing the rotational position of the cam thereby adjusting the point in the vertical rotary motion of the rotating member where the groove of the cam comes in contact with the cable and causes the lever arm to pivot upwardly.

2. The low inertia counterbalance mechanism of claim 1 wherein the constant force spring is a gas spring.

3. The low inertia counterbalance mechanism of claim 1 wherein the top end of the constant force spring is pivotally attached to the frame and also comprising a slide means movably attached to the lever arm intermediate the first end and the second end of the lever arm wherein the bottom end of the spring is pivotally attached to the slide means and the position of the slide means on the lever arm is adjustable.

4. The low inertia counterbalance mechanism of claim 1 also comprising means for taking up slack in the cable.

5. The low inertia counterbalance mechanism of claim 4 wherein the means for taking up slack in the cable comprises a turnbuckle located intermediate the top end and the bottom end of the cable.

6. The low inertia counterbalance mechanism of claim 3 wherein, when the rotating member is engaged in upward rotational motion, the constant force spring through the lever arm applies a force to the cable and the cable through the cam applies a rotational force to the mass of the rotating member helping the mass of the rotating member overcome gravity.

7. The low inertia counterbalance mechanism of claim 6 wherein the position of the slide means on the lever arm can be adjusted to overcome gravity and passively carry the mass of the rotating member through the upward rotational motion.

8. The low inertia counterbalance mechanism of claim 1 wherein the adjusting means comprises a position plate mounted on the rotating member and having the same axis of rotation as the rotating member wherein a pull pin on the cam is engaged in one of a number of counterbalance holes on the position plate.

9. A test, rehabilitation and exercise machine comprising in combination:

an input assembly wherein an upper body mass of a person using the machine is secured within the input assembly and wherein the input assembly engages in vertical rotary motion;

a force generating means attached to the input assembly wherein said force generating means comprises an isokinetic dynamometer which provides an accommodating resistive force equal to the force exerted by the person against the input assembly after the input assembly reaches a pre-determined speed;

a low inertia counterbalance mechanism for negating the effect of gravity on the upper body mass of the person secured in the input assembly, the low inertia counterbalance mechanism comprising:

a cam mechanically connected to the input assembly and having the same axis of rotation as the input assembly wherein the can rotates when the input assembly rotates;

a lever arm with a first end pivotally attached to a frame of the machine;

a cable with a top end attached to the axis of rotation of the input assembly and a bottom end attached to a second end of the lever arm wherein a groove of the cam comes in contact with the cable as the input assembly rotates downwardly in the direction of the force of gravity, causing the lever arm to pivot upwardly;

a constant force spring with a top end attached to the frame and a bottom end attached to the lever arm at a point intermediate the first end and the second end of the lever arm, wherein the top end of the constant force spring is always at a higher elevation than the bottom end of the constant force spring and wherein the constant force spring is compressed when the lever arm is pivoted upwardly opposite to the direction of the force of gravity negating the effect of gravity on the upper body mass of the person secured in the input assembly as the input assembly is rotated downwardly and, when the input assembly is rotating upwardly, the constant force spring through the lever arm applies a force to the cable and the cable through the cam applies a rotational force to the input assembly helping the upper body mass of the person secured to the input assembly overcome gravity; and means for changing the rotational position of the cam thereby adjusting the point in the vertical rotary motion of the rotating member where the groove of the cam comes in contact with the cable and causes the lever arm to pivot upwardly.

* * * * *

UNITED STATES PATENT AND TRADEMARK OFFICE

CERTIFICATE OF CORRECTION

PATENT NO. : 4,725,054

DATED : February 16, 1988

INVENTOR(S) : Solow et al.

It is certified that error appears in the above—identified patent and that said Letters Patent is hereby corrected as shown below:

In claim 9 at column 9, line 16, "can" should be --cam--.

Signed and Sealed this

Ninth Day of May, 1989

*Attest:*

DONALD J. QUIGG

*Attesting Officer*

*Commissioner of Patents and Trademarks*